United States Patent [19]

Harris et al.

[11] Patent Number: 4,735,268

[45] Date of Patent: Apr. 5, 1988

[54] MECHANICAL SETTING TOOL

[75] Inventors: Monty E. Harris, Azle; Richard A. Sukup, Burleson, both of Tex.

[73] Assignee: The Western Company of North America, Fort Worth, Tex.

[21] Appl. No.: 914,649

[22] Filed: Oct. 2, 1986

[51] Int. Cl.[4] ..... E21B 23/00

[52] U.S. Cl. ..... 166/382; 166/216; 166/217; 166/124

[58] Field of Search ..... 166/216, 217, 381, 382, 166/181, 182, 123–125, 208, 210, 213

[56] References Cited

U.S. PATENT DOCUMENTS

| | | | |
|---|---|---|---|
| 3,232,347 | 2/1966 | Thrane | 166/124 |
| 3,270,819 | 9/1966 | Thrane et al. | 166/124 |
| 3,519,074 | 7/1970 | Berryman | 166/217 |
| 4,440,233 | 4/1984 | Baugh et al. | 166/382 |
| 4,441,560 | 4/1984 | Baugh et al. | 166/382 |
| 4,489,781 | 12/1984 | Weeks | 166/217 |
| 4,496,000 | 1/1985 | Weeks | 166/216 |

*Primary Examiner*—Stephen J. Novosad
*Assistant Examiner*—Bruce M. Kisliuk
*Attorney, Agent, or Firm*—Richards, Harris, Medlock & Andrews

[57] ABSTRACT

A mechanical setting tool for setting a flow control tool in an oil or gas well using the drill string includes a mandrel with means for attachment to the end of the drill string. Slips are releasably carried on the mandrel by a first release structure. A cone is releasably carried on the mandrel by a second release structure and has tapered surfaces confronting the slips. A stinger is carried on the lower end of the mandrel and has a third release means for releasably engagement to the flow control tool being set. A setting sleeve is releasably engaged to the mandrel by way of a fourth release structure between the sleeve and the cone.

15 Claims, 4 Drawing Sheets

FIG. 1a
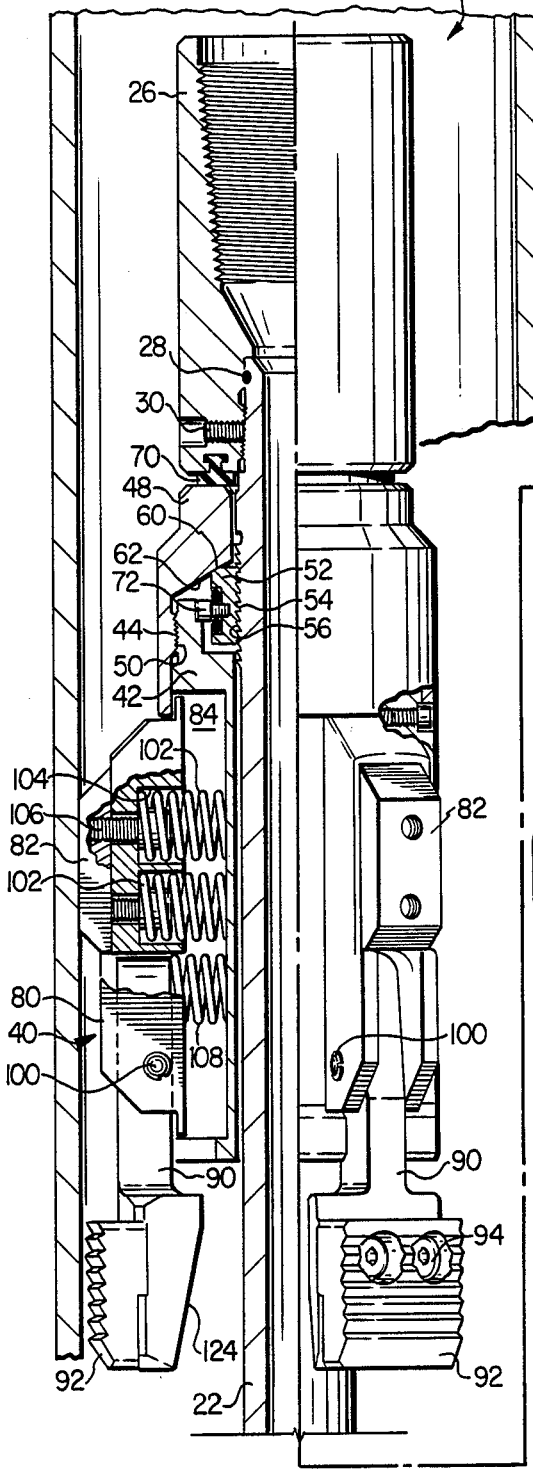
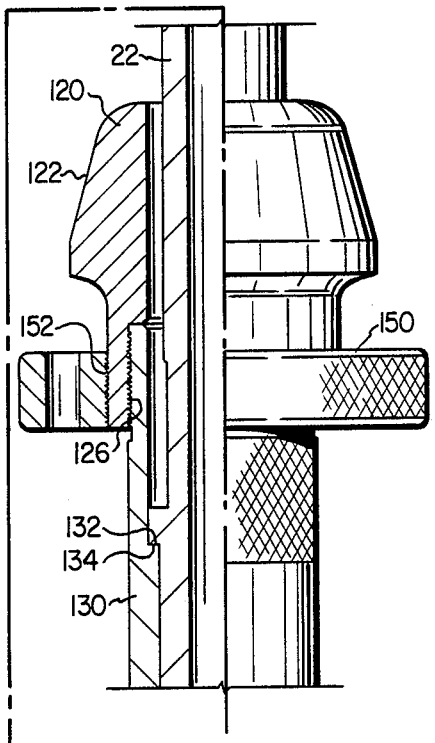
FIG. 1b

MECHANICAL SETTING TOOL

TECHNICAL FIELD

The present invention relates to a mechanical setting tool for use in setting flow control tools downhole in oil and gas wells, and more specifically, relates to a mechanical setting tool having integral slips.

BACKGROUND ART

In the production and stimulation of oil and gas wells, special flow control tools, such as cement retainers and bridge plugs, must be set downhole. These flow control tools are set at the desired depth within the well using a setting tool. The setting tools are normally activated hydraulically, mechanically or by wireline. In deviated holes, hydraulic or wireline activated setting tools are generally preferred. In other wells, where the hole is not deviated as to preclude the mechanical setting of the flow control tool, a mechanical setting tool may be preferred. This is particularly the case where shallow depths are involved.

Past mechanical setting tools, while used for many years, had been overly complex and susceptible to premature setting. For example, in setting a flow control tool mechanically, the tool is mounted to the mechanical setting tool which is lowered into the well casing on the end of the pipe string. The setting tool is normally actuate by rotating the pipe string to actuate control mechanisms on the setting tool and by picking up and lowering the pipe string to further actuate the setting tool to set the flow control tool. Great care must be exercised to prevent premature setting of the tool. In fact, a primary problem with mechanical setting tools is the problem occasioned by premature setting, which results in the flow control tool being set at the incorrect depth. Such "misfires" require the drilling out the flow control tool which results in substantial loss to the operator.

Prior setting tools have also been extremely complex in their design and require a sequence of steps for actuation. Such sequence may be easily confused and is generally difficult to follow, causing the unsuccessful use of the setting tool in many cases. Further, many of the tools require auxiliary slips which are incorporated on the flow control tool. Generally, the flow control tool which is mechanically set is different in design from that which is to be hydraulically set. Thus, two separate flow control tools must be maintained on-hand, depending upon the method of setting.

Thus, a need exists for a mechanical setting tool which effectively eliminates the possibility of premature setting while running the setting tool in the well. Further, the need exists for a setting tool which can be easily actuated and removed subsequent to setting of the flow control tool.

DISCLOSURE OF THE INVENTION

The present invention provides a mechanical setting tool for actuating flow control tools at desired depths in oil and gas wells and provides a novel structure which overcomes many of the deficiencies found in prior art mechanical setting tools. In accordance with one embodiment of the invention, a mechanical setting tool for setting a flow control tool in an oil or gas well using the drill string includes a mandrel with means for attachment to the end of the drill string. Slips are releasably carried on the mandrel by a first release structure. A cone is releasably carried on the mandrel by a second release structure and has tapered surfaces confronting the slips. A stinger is carried on the lower end of the mandrel and has a third release means for releasably engagement to the flow control tool being set. A setting sleeve is releasably engaged to the mandrel by way of a fourth release structure between the sleeve and the cone.

The release structure between the slips and the mandrel is a threaded engagement which can be actuated only by applying a lifting force on the drill string in conjunction with rotating the drill string and mandrel. In a primary embodiment, shear pins are used as the release structure between the cone and mandrel, between the stinger and flow control tool and between the setting sleeve and the cone.

In setting the flow control tool, the mechanical setting tool is positioned at the desired depth and the integral slips are released from the mandrel by lifting and rotating the drill string and mandrel attached thereto. After the slips are released, the mandrel is lifted further to engage the tapered surface of the cone against the slips, forcing the slips outwardly into engagement with the casing, thereby fixing the tool relative to the casing. An increased upward pull then operates to set the flow control tool by pulling the stinger attached to the mandrel relative to a setting sleeve which is coupled to the slip setting cone. Once the flow control tool is set, increased upward pull shears a ring between the stinger and the flow control tool thereby releasing the setting tool from the flow control tool. The upward travel of the stinger and associated structure shears the shear pin between the setting sleeve and the cone thereby releasing the cone from engagement with the slips. The slips are retracted under the action of appropriate springs in the setting tool thereby releasing the setting tool from the well casing. The tool, still coupled to the drill string, may then be removed from the well.

BRIEF DESCRIPTION OF THE DRAWINGS

For a more complete understanding of the present invention and further details and advantages thereof, reference is now made to the following Detailed Description taken in conjunction with the accompanying Drawings, in which:

FIGS. 1*a*, 1*b*, 1*c* and 1*d* are quarter section views, partially broken away, of the tool of the present invention;

DETAILED DESCRIPTION

Figure 1C:
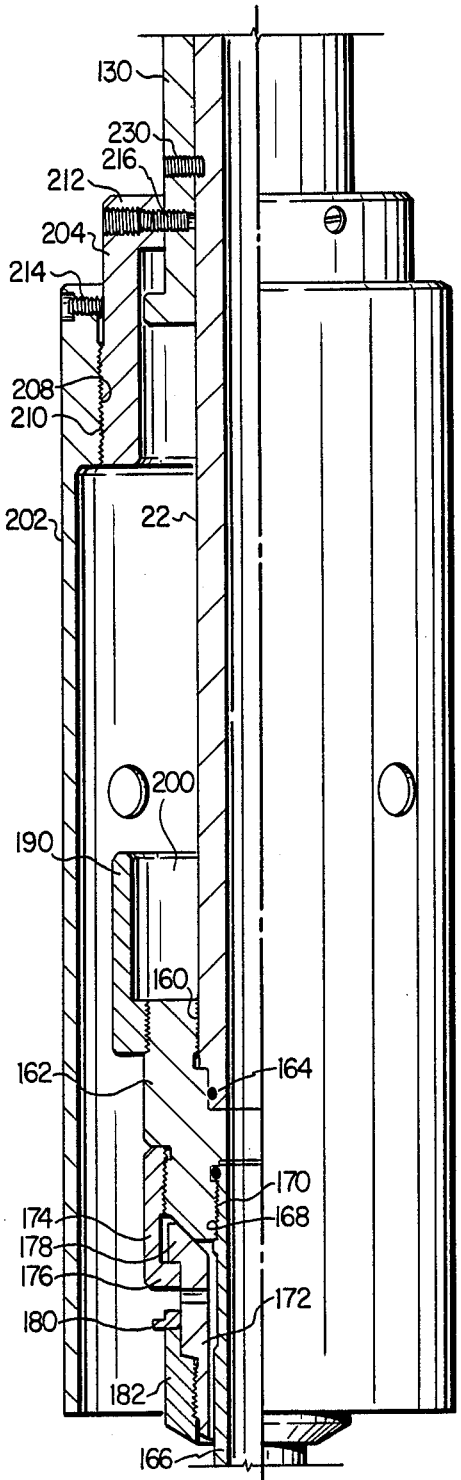

The present invention provides a mechanical setting tool for setting flow control tools and valves in oil and gas wells. Referring to FIG. 1*a* through 1*d*, mechanical setting tool 20 is shown in a quarter section view, partially broken away. Tool 20 is shown positioned in casing C and includes a mandrel 22 having a threaded upper end for receiving an upper adapter 26 attached thereto. The connection between adapter 26 and mandrel 22 is made fluid tight by the use of an O-ring 28 which is positioned in an annular groove at the upper end of mandrel 22. Upper adapter 26 is retained in position by set screw 30 and has a box end for attachment to the pipe string.

A slip assembly 40 is carried on mandrel 22 below upper adapter 26. Slip assembly 40 includes a carrier 42 positioned around mandrel 22 and having external threads 44 on its upper end. Carrier 42 is threadedly attached to a slip collar 48 which is also received around mandrel 22. Collar 48 has internal threads 50 which are engaged to external threads 44 of carrier 42. The union of carrier 42 and collar 48 defines an annular cavity in which slip retainer nut 52 is positioned. Nut 52 has internal threads 54 which may threadedly engage external threads 56 on mandrel 22. However, nut 52 is also segmented, and thus may also ride up, and move away from threads 56, within the cavity defined between carrier 42 and collar 48 unless an upward pull is exerted on mandrel 22. More specifically, nut 52 has a tapered upper surface 60 which corresponds to a downwardly facing tapered surface 62 of collar 48. As will be described hereinafter in greater detail, by lifting up on mandrel 22, nut 52 is made to engage collar 48 such that the tapered surfaces act to force the segmented nut into engagement with threads 56 of mandrel 22. Nut 52 is keyed to carrier 42 by retaining screws 72.

A resilient bushing 70 is positioned between collar 48 and upper adapter 26.

Slip carrier 42 receives a plurality of circumferentially spaced drag pad supports 80, each having a drag pad 82 attached thereto, within cavities 84. Drag pads 82 are biased outwardly by springs 102 for engagement against the inner wall of casing C as the tool is moved into and through the casing in the usual manner. Springs 102 have their radially outward ends engaged in bores 104 in supports 80, as shown in FIG. 1*a*. As is also shown, the attachment of drag pads 82 to drag pad supports 80 is by bolts 106. A slip 90, including a shaft 96, is pivotally attached to each drag pad support 80 and carries a slip pad 92 on one end thereof. Pads 92 are attached by appropriate bolts 94. Each slip 90 is pivotally attached to a drag pad support 80 by a pivot pin 100. A spring 108 is positioned within cavity 84 and between shaft 96 and support 80 to normally position the slip 90 in the retracted position shown in FIG. 1*a*.

Referring now to FIG. 1*b*, a slip setting cone 120 is received around mandrel 22. Cone 120 has a tapered surface 122 which confronts inwardly facing surfaces 124 of slips 90. As can be seen in FIG. 1*a*, surfaces 124 face inwardly and are opposite slip pads 92. Referring again to FIG. 1*b*, cone 120 has internal threads 126 on the end opposite tapered surface 122 which is threadedly received onto a cone sleeve 130, also engaged around mandrel 22. Cone sleeve 130 has a step 132 therein which confronts an annular ring 134 protruding from mandrel 22. A locking collar 150 is threadedly received onto external threads 152 of cone 120. Collar 150 serves to fix cone 120 relative to sleeve 130.

FIG. 1*c* shows the bottom end of mandrel 22 and its attachment by way of external threads 160 to a sleeve connector 162. An O-ring 164, received in an annular groove in mandrel 22, provides a fluid tight seal between mandrel 22 and sleeve connector 162. A stinger 166 is attached to the bottom end of mandrel 22 by connection to sleeve connector 162. Stinger 166 has external threads 168 which are engaged with internal threads 170 at the lower end of sleeve connector 162. A flow control tool adapter fitting 172 is received around stinger 166 and is attached to sleeve connector 162 by attachment collar 174. Attachment collar 174 has an inturned ring end 176 which engages an annular step 178 on tool adapter 172. The collar is threadedly received on the end of sleeve connector 162. A cone release sleeve 190 is threadedly received on the upper end of sleeve connector 162. Cone release sleeve 190 defines an internal bore and an annular cavity around mandrel 22 identified by the numeral 200.

FIG. 1*c* also shows setting sleeve 202 which is connected by a cross-link sleeve 204 to cone sleeve 130. Setting sleeve 202 has internal threads 208 which engage external threads 210 of cross-link sleeve 204. A set screw 214 completes the connection therebetween. Setting sleeve 202 also defines an annular cavity between mandrel 22 and the sleeve.

Cross-link sleeve 204 has an inturned ring 212 defining an internal diameter substantially equal to the external diameter of cone sleeve 130. A bore is formed through the annular ring and a shear screw 216 is engaged therein and into a receiving threaded aperture in cone sleeve 130. The lower end of cone sleeve 130 also has a external ring 218 received within the annular cavity defined within cross-link sleeve 204. Cone sleeve 130 is releasably coupled to mandrel 22 by way of a shear pin 230 which is received in a threaded aperture through cone sleeve 130 and into a threaded aperture within mandrel 22.

Referring still to FIG. 1*c*, a shear ring 180 is received on tool adapter 172 for engagement of the flow control tool to be operated by the setting tool 20. Shear ring 180 is held in position by an appropriate fitting 182. As can be seen in FIG. 1*c*, cone release sleeve 190 is actually aligned with cone link sleeve 204, the significance of which will become more apparent in discussion of the operation of the tool below.

Figure 1D:
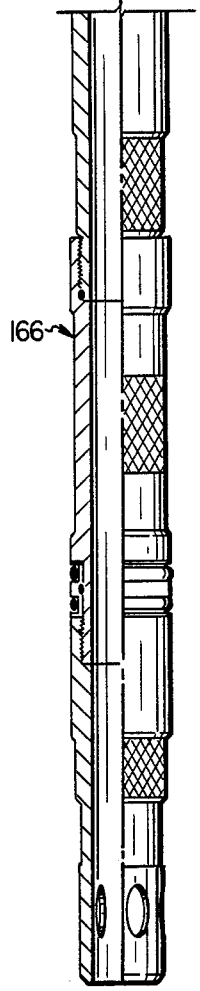

FIG. 1*d* shows the lower end of stinger 166. The structure of stinger 166 is designed to actuate various flow control tools. The general structure is a well known in the art and therefore a detailed description will not be provided here.

OPERATION OF THE TOOL

The sequence of preferred operation of the mechanical setting tool 20 is depicted in the sequences shown in FIGS. 1 through 5. A flow control tool, such as a cement retainer or bridge plug, is first attached to the setting tool over stinger 166 and is coupled to tool adapter 172 by shear ring 180. The setting tool and flow control tool combination is then run into the well to the desired depth. As the tool is run into the well, it is in the loaded position shown in FIG. 1*a*. When the flow control tool reaches the desired depth in the casing, the sequence of operation to set the tool is begun. In the present invention, this sequence is greatly simplified in comparison with prior art tools and includes rotating the drill string with an upward pull followed by two successive upward pulls of increasing magnitude.

Figure 2:
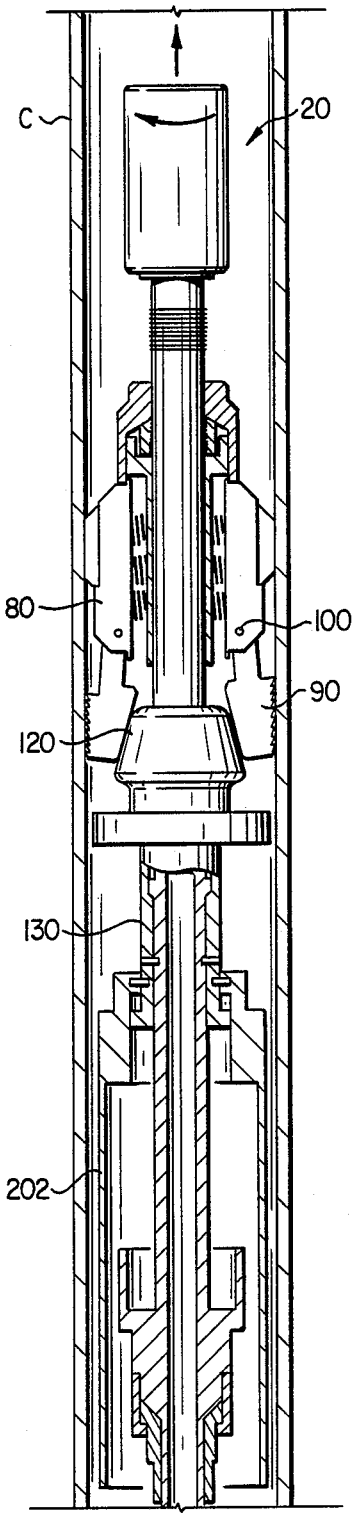
FIG. 2 is a section view showing the setting tool with the integral slips set against the well casing.

Specifically, the drill string is rotated to rotate upper adapter 26 which in turn rotates mandrel 22. An upward pull is simultaneously applied on mandrel 22. This is accomplished through an upward pull on the drill string. Because drag pads 82 are biased by springs 102 into engagement with casing C, carrier 42 and collar 48 remains stationary relative to the casing as the mandrel rotates. The upward pull on mandrel 22 engages segmented nut 52 against collar 48 forcing the nut sections inwardly into threaded engagement with threads 56 of mandrel 22. As a result, nut 52 is lowered along threads 56 until it is released therefrom. The release of nut 52 from mandrel 22 permits the upward movement of mandrel 22 relative to slip assembly 40. The upward pull on the drill string results in the movement of slip setting cone 120, and particularly tapered surface 122 thereof, into engagement with slips 90. The contact of tapered surface 122 with the corresponding surfaces 124 result in the outward movement of slip pads 92 into engagement with casing C. This "slip engaged" position is shown in FIG. 2.

Figure 3:
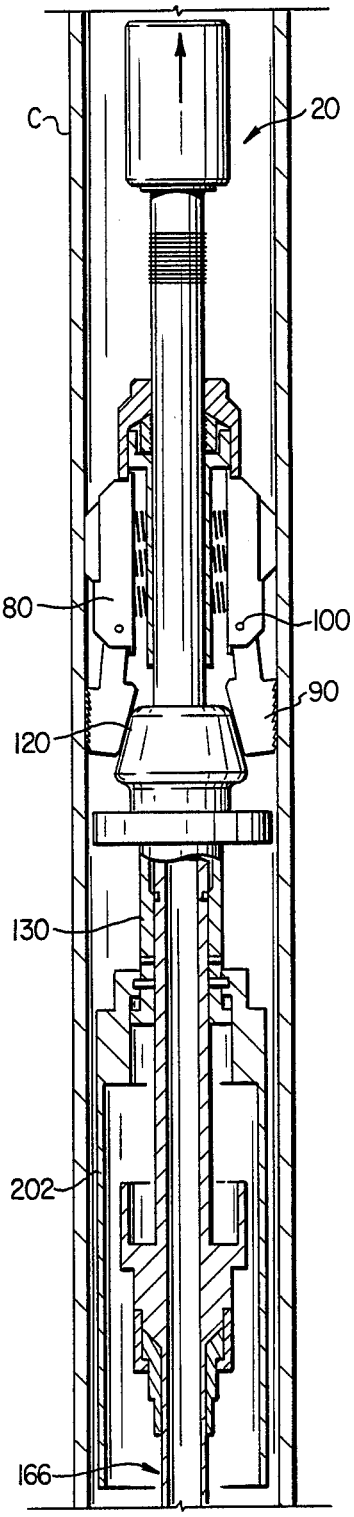
FIG. 3 is a section view of the setting tool in its position subsequent to setting of the flow control tool.
Figure 4:
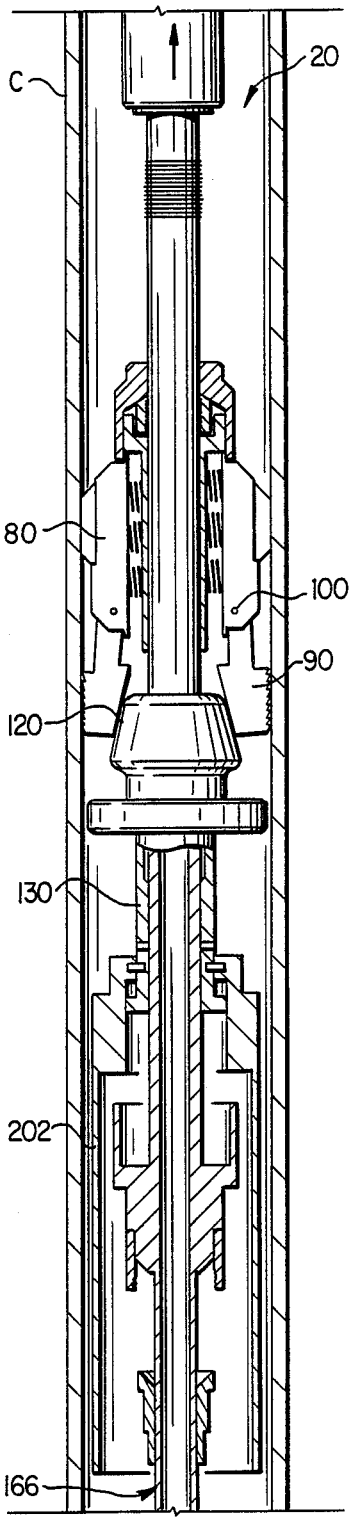
FIG. 4 is a section view of the tool sheared out from the control tool.

By continuing to apply an upward force to the drill string, mandrel 22 is drawn upwardly relative to slip assembly 40 (FIG. 3). The force applied to the mandrel through lifting the drill string results in shearing shear pin 230 (FIG. 1*c*) connecting cone sleeve 130 with mandrel 22. In one embodiment, this shear occurs at 700 lbs load.

Shearing shear pin 230 permits the movement of stinger 166 upwardly drawing the fluid control tool upwardly, in the casing relative to setting sleeve 202. As is well known in the art, this relative movement operates to set the fluid control tool by operating on the tool components which either expand packers or complete other operations as designed. Because the setting of the flow control tool is not a specific part of the present invention, it will not be discussed in detail, but is well known to those skilled in the art. An example of setting such a tool is shown in U.S. Pat. No. 4,484,625, which is assigned to the assignee of the present application and which is incorporated herein by reference for all purposes.

Figure 5:
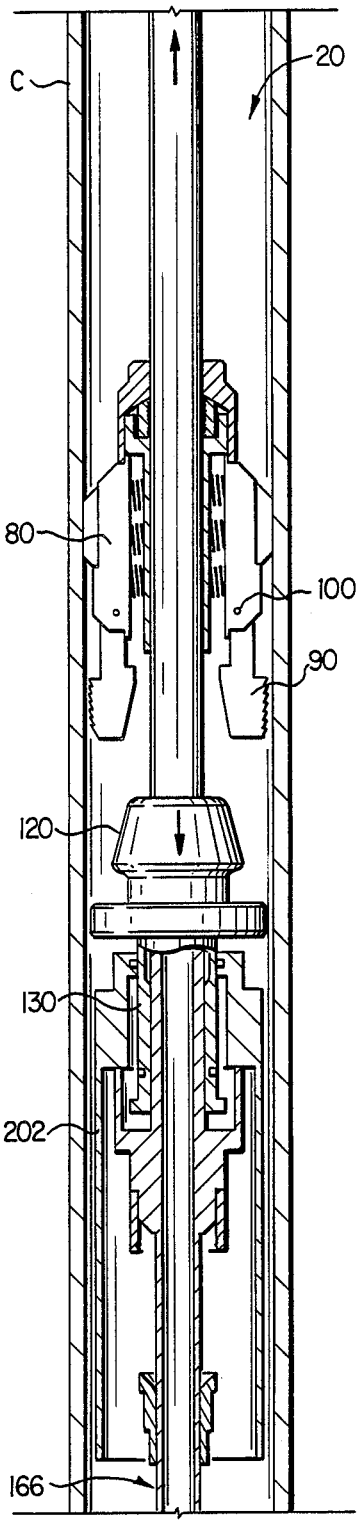
FIG. 5 is a section view of the tool with the tool released from engagement against the casing, ready for removal from the well.

Once a sufficient force has been applied to set the flow control tool, continued pull is applied to mandrel 22 by lifting on the drill string until the tool is released from the flow control tool by shearing shear ring 180. In one embodiment, this shear is accomplished at 10,000 lbs. load. Prior to shearing, substantial elongation is experienced in the drill string and the release of the setting tool from the flow control tool results in a sudden contraction of the drill string and movement of mandrel 22 relative to setting sleeve 202. As a result, cone release sleeve 190 engages cross-link sleeve 204 with a sudden impact and shears shear pin 216, thereby disengaging cross-link sleeve 204 from cone sleeve 130. As can be appreciated by those skilled in the art, the shear capability of shear pin 216 is greater than that of shear ring 180. The separation of sleeve 204 from cone sleeve 130 permits the movement of cone 120 downwardly relative to mandrel 22 and away from slips 90 (FIG. 5). The movement of cone 120 away from slips 90 is assisted by the action of springs 108 against the ends of slips 90 opposite pivot 100 from slip pads 92. Springs 108 act to pivot slips 90 such that slip pads 92 are disengaged from contact with the inside wall of casing C. At this point in the operation of the tool, the slip assembly 40 is disengaged from the casing, and the setting tool is disengaged from the flow control tool, which has now been set. Thus, the setting tool may be removed from the well by withdrawing the drill string.

Thus, the present invention provides a novel mechanically setting tool for setting a flow control device in an oil or gas well. The tool includes a mandrel with means for attachment of the mandrel to the end of the drill string. Slips are releasably carried on the mandrel and are releasable by rotation of the mandrel and the resulting unthreading of a slip retainer nut which restrains movement of the slip during introduction of the tool into the well. The slip retainer nut is actuated by rotation of the mandrel and by applying an upward pull thereto. A setting cone is releasably carried on the mandrel and has a tapered surface confronting the slips. A stinger is carried on the end of the mandrel and has releasable means for engagement of the flow control tool being set. A setting sleeve is releasably engaged to the mandrel by a shear pin between the sleeve and the setting cone.

In setting the flow control tool, the tool is positioned at the desired depth in the well and the integral slips are released from the mandrel by lifting and rotating the drill string and mandrel attached thereto. After the slips are released, the mandrel is lifted further to engage the tapered surface of the slip setting cone against the slips, forcing the slips outward into engagement with the casing, thereby fixing the tool relative to the casing. An increased upward pull then operates to set the flow control tool by pulling the stinger attached to the mandrel relative to the setting sleeve which is coupled to the slip setting cone. Once the flow control tool is set, increased upward pull shears the connecting ring between the stinger and the flow control tool thereby releasing the setting tool from the flow control tool. The upward travel of the stinger and associated structure shears the shear pin connection between the setting sleeve and the cone thereby releasing the cone from engagement with the slips. The slips are retracted thereby releasing the setting tool from the well casing, and the tool is removed with the removal of the drill string.

Thus, the present invention provides a setting tool which effectively eliminates the possibility of premature setting of the setting tool during positioning of the flow control tool within the casing. This is a result of the requirement of a rotation plus an upward pull to disengage the slip assembly from the setting tool. Rotation alone will not result in actuation of the setting tool in that segmented nut 52 merely rotates over threads 56 of mandrel 22 until a load is applied by lifting the mandrel. Further, during the setting operation, no complicated procedure is required to set the tool. Rather, the tool is set by merely rotating and lifting on the drill string. Because of the sequential higher loads required to shear shear pins 230, shear ring 180 and shear pin 216, a continuous pull on the drill string will result in successful setting of the present tool. Thus, no complex procedure for actuation of the tool must be followed.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications and substitutions of parts and elements as fall within the scope of the invention.

We claim:

1. A mechanical setting tool for setting a downhole tool in an oil or gas well casing comprising:

a mandrel;

slips releasably carried on said mandrel;

means for releasing said slips for relative downward movement on said mandrel, comprising a segmented nut engaged between said slips and said mandrel and keyed to said slips, said nut having internal threads cooperating with external threads on said mandrel such that rotation of said mandrel relative to said slips releases said slips for movement longitudinally relative to said mandrel, said nut having a downwardly and outwardly tapered surface on the upwardly facing surface thereof corresponding to a downwardly and outwardly confronting surface on the downwarly facing surface of said slips such that an upward pull on said nut relative to said slips forces said nut inwardly to engage the internal threads of said nut with the external threads of said mandrel, slip setting means carried on said mandrel below said slips and responsive to an uphole pull on said mandrel for setting said slips;

tool setting means for setting said downhole tool by the continued uphole pull on said mandrel; and slip release means for releasing said slips by a further uphole pull on said, mandrel to permit said setting tool to be removed from the well.

2. The mechanical setting tool according to claim 1 wherein said nut is free to ratchet relative to said mandrel when there is no upward pull placed on said nut relative to said slips.

3. A mechanical setting tool for setting a downhole tool in an oil or gas well casing comprising:

a mandrel;

slip releasably carried on said mandrel;

means for releasing said slips for relative downward movement on said mandrel comprising a segmented threaded nut engaged between said slips and said mandrel, said nut having internal threads confronting external threads on said mandrel;

means responsive to the upward pull of said mandrel relative to said slips to force said threads of said nut into engagement with the threads of said mandrel;

slip setting means carried on said mandrel below said slips and responsive to an uphole pull on said mandrel for setting said slips;

tool setting means for setting said downhole tool by the continued uphole pull on said mandrel; and slip release means for releasing said slips by a further uphole pull on said mandrel to permit said setting tool to be removed from the well.

4. The mechanical setting tool according to claim 3 further comprising:

drag pad means attached to said slips for normally engaging the well casing to resist rotational movement of the slips upon rotation of the mandrel; and means for keying said nut to said drag pad means such that said mandrel may be rotated relative to said nut.

5. A mechanical setting tool for setting a downhole tool in an oil or gas well casing comprising:

a mandrel;

slips releasably carried on said mandrel;

means for releasing said slips for relative downward movement on said mandrel;

slip setting means carried on said mandrel below said slip and responsive to an uphole pull on said mandrel for setting said slips, said slip setting means comprising a cone releasably carried on said mandrel and confronting said slips whereby an uphole pull on said mandrel engages said cone against said slips forcing them outwardly to engage the casing thereby setting the mechanical setting tool;

tool setting means for setting said downhole tool by the continued uphole pull on said mandrel comprising a stinger and releasably carried on the end of said mandrel engaging the downhole tool being set;

a setting sleeve releasably engaged to said cone whereby pulling said mandrel uphole draws said downhole tool being set against said setting sleeve whereby said downhole tool is set; and slip release means for releasing said slips by further uphole pull on said mandrel to permit said setting tool to be removed from the well comprising a shear pin between said setting sleeve and said cone whereby the uphole pull shears said pin permitting said cone to be moved relative to the mandrel from said slips, thereby releasing said slips and permitting said setting tool to be removed from the well.

6. The mechanical setting tool according to claim 5 further comprising:

means for normally biasing said slips radially inwardly.

7. A mechanical setting tool for setting a downhole tool in casing of an oil or gas well using the well drill string comprising:

a mandrel; means for connecting said mandrel to the drill string; slips releasably carried on the mandrel by a first release means, comprising a segmented nut engaged between said slips and said mandrel and keyed to said slips, said nut having internal threads cooperating with external threads on said mandrel such that rotation of said mandrel relative to said slips releases said slips for movement longitudinally relative to said mandrel, said segmented nut having a downwardly and outwardly tapered surface on the upwardly facing surface thereof corresponding to a downwardly and outwardly confronting surface on the downwardly facing surface of said slips such that an upward pull on said nut relative to said slips forces said nut inwardly to engage the internal threads of said nut with the external threads of said mandrel;

a cone releasably carried on said mandrel by second release means, said cone having a tapered surface confronting said slips;

a stinger carried on the end of said mandrel and having a third release means for releasable engagement to the downhole tool being set; and a setting sleeve releasably engaged to the mandrel by way of a forth release means.

8. The mechanical setting tool according to claim 7 wherein said nut is free to ratchet relative to said mandrel when there is no upward pull placed on said nut relative to said slips.

9. The mechanical setting tool according to claim 8 further comprising:

drag pad means attached to said slips for normally engaging the well casing to resist rotational movement of the slips upon rotation of the mandrel; and means for keying said nut to said drag pad means such that said mandrel may be rotated relative to said nut.

10. A mechanical setting tool for setting a downhole tool in casing of an oil or ga well using the well drill string comprising:

a mandrel;

means for connecting said mandrel to the drill string;

slips releasably carried on the mandrel by a first release means comprising a threaded connection;

a cone releasably carried on said mandrel by second release means comprising a first shear pin said cone having a taped surface confronting said slips;

a stinger carried on the end of said mandrel and having a third release means for releasable engagement to the downhole tool being set said third release means comprising a second shear pin; and a setting sleeve releasably engaged to the mandrel by way of a fourth release means comprising a third shear pin.

11. The mechanical setting tool according to claim 10 wherein said first, second and third shear pins have increasing shear failure limits such that the shear limit of the third shear pin is greater than that of the second shear pin and that of the second shear pin is greater than that of the first shear pin.

12. A mechanical setting tool for setting a downhole tool in casing of an oil or gas well using the well drill string comprising:

a mandrel;

means for connecting said mandrel to the drill string;

slips releasably carried on the mandrel by a first release means;

a cone releasably carried on said mandrel by second release means, said cone having a tapered surface confronting said slips;

a stinger carried on the end of said mandrel and having a third release means for releasable engagement to the downhole tool being set; and a setting sleeve releasably engaged to the mandrel by way of a fourth release means comprising release structure between said setting sleeve and said cone.

13. A method of mechanically setting a downhole tool in the casing of an oil or gas well using a setting tool comprising an elongated mandrel connected on the end of the pipe drill string comprising:

rotating said drill string and applying an upward pull to rotate the tool mandrel and release slips threadedly received on the mandrel;

applying an initial upward pull to set the slips released by rotating the drill string;

applying a further upward pull to set the downhole tool by shearing a connecting shear pin between said mandrel and cone to permit the tool stringer to be raised relative to a setting sleeve to thereby set the downhole tool; and applying a still further upward pull to disengage the setting tool from the downhole tool and to release the slips to permit removal of the tool from the well.

14. The method according to claim 13 wherein said initial upward pull comprises:

drawing a cone carried on the mandrel into engagement with the slips and forcing the slips outwardly against the casing.

15. A method of mechanically setting a downhole tool in the casing of an oil or gas well using a setting tool comprising an elongated mandrel connected on the end of a pipe drill string comprising:

rotating said drill string and applying an upward pull to rotate the tool mandrel and release slips threadedly received on the mandrel;

applying an initial upward pull to set the slips released by rotating the drill string;

applying a further upward pull to set the downhole tool; and applying a still further upward pull to disengage the setting tool from the downhole tool and to release the slips to permit removal of the tool from the well by shearing said setting tool from the downhole tool and shearing a connecting shear pin between the setting sleeve and cone to permit the cone to move away from the slips, disengaging the slips from the casing, thereby permitting removal of the setting tool from the well.

* * * * *